US009983512B2

(12) United States Patent
Ishizuka et al.

(10) Patent No.: US 9,983,512 B2
(45) Date of Patent: May 29, 2018

(54) TONER CONVEYANCE DEVICE AND IMAGE FORMING APPARATUS

(71) Applicants: Yusuke Ishizuka, Kanagawa (JP); Takeshi Shintani, Kanagawa (JP); Yasuhiro Maehata, Tokyo (JP); Hiroshi Mizusawa, Tokyo (JP); Daisuke Tomita, Kanagawa (JP); Yuta Azeyanagi, Kanagawa (JP); Yasuhito Kuboshima, Tokyo (JP)

(72) Inventors: Yusuke Ishizuka, Kanagawa (JP); Takeshi Shintani, Kanagawa (JP); Yasuhiro Maehata, Tokyo (JP); Hiroshi Mizusawa, Tokyo (JP); Daisuke Tomita, Kanagawa (JP); Yuta Azeyanagi, Kanagawa (JP); Yasuhito Kuboshima, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/429,552

(22) Filed: Feb. 10, 2017

(65) Prior Publication Data

US 2017/0261887 A1 Sep. 14, 2017

(30) Foreign Application Priority Data

Mar. 8, 2016 (JP) ..... 2016-044137

(51) Int. Cl.
*G03G 15/08* (2006.01)

(52) U.S. Cl.
CPC ..... *G03G 15/0891* (2013.01)

(58) Field of Classification Search
CPC ..... G03G 15/0891
See application file for complete search history.

(56) References Cited

U.S. PATENT DOCUMENTS 6,085,062 A * 7/2000 Mizuishi ..... G03G 21/105 399/358
6,366,755 B1 * 4/2002 Takashima ..... G03G 15/0822 399/254
7,149,467 B2 * 12/2006 Stickler ..... G03G 21/12 399/107

(Continued)

FOREIGN PATENT DOCUMENTS

JP 2001-147629 5/2001

*Primary Examiner* — David Bolduc
(74) *Attorney, Agent, or Firm* — Harness, Dickey & Pierce, P.L.C.

(57) ABSTRACT

A toner conveyance device includes a downward passage, a reciprocating member disposed in the downward passage, to move in a vertical direction in which the downward passage extends, a conveyance passage communicating with a lower end of the downward passage and extending in a direction crossing the vertical direction, a conveyor to rotate in the conveyance passage around an axis extending along the conveyance passage to transport the toner, and a flexible member projecting from a bottom of the reciprocating member toward the conveyance passage. The flexible member extends in the axial direction of the conveyor and moves together with the reciprocating member. When the reciprocating member is at a lowest position, a lower end of the flexible member opposes a portion of the conveyor downstream from an upper end thereof in a rotation direction thereof.

20 Claims, 6 Drawing Sheets

(56) References Cited

U.S. PATENT DOCUMENTS 7,221,880 B2 * 5/2007 Jeong ..... G03G 21/105 399/35
2006/0018690 A1 * 1/2006 Blair ..... G03G 21/105 399/358
2007/0292179 A1 * 12/2007 Kudo ..... G03G 15/161 399/358
2008/0118290 A1 * 5/2008 Sato ..... G03G 21/105 399/358
2009/0067873 A1 * 3/2009 Gunbe ..... G03G 21/105 399/99
2009/0110429 A1 * 4/2009 Kitaoka ..... G03G 15/0822 399/99
2009/0154972 A1 * 6/2009 Tanaka ..... G03G 21/105 399/358
2009/0257798 A1 * 10/2009 Hoshino ..... G03G 21/105 399/358
2009/0324294 A1 * 12/2009 Ichikawa ..... G03G 15/0877 399/258
2010/0080637 A1 * 4/2010 Yamaguchi ..... G03G 21/10 399/358
2010/0119270 A1 * 5/2010 Hoshino ..... G03G 21/105 399/358
2010/0172674 A1 * 7/2010 Suzuki ..... G03G 15/0879 399/258
2010/0247192 A1 * 9/2010 Ishikawa ..... G03G 21/12 399/358
2012/0020683 A1 * 1/2012 Miura ..... G03G 15/0862 399/27
2013/0017001 A1 * 1/2013 Yamanaka ..... G03G 15/0879 399/258
2013/0251433 A1 * 9/2013 Toshiyuki ..... G03G 21/10 399/358
2014/0076691 A1 * 3/2014 Yamada ..... G03G 15/0189 198/548
2014/0169852 A1 6/2014 Satoh et al.
2014/0314461 A1 * 10/2014 Ishizuka ..... G03G 21/0035 399/358
2015/0078795 A1 3/2015 Kuwabara et al.
2015/0346638 A1 12/2015 Mizusawa et al.
2016/0147181 A1 * 5/2016 Inoue ..... G03G 15/0848 399/27
2017/0108802 A1 * 4/2017 Murakami ..... G03G 15/0891

* cited by examiner

TONER CONVEYANCE DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2016-044137, filed on Mar. 8, 2016, in the Japan Patent Office, the entire disclosure of which is hereby incorporated by reference herein.

BACKGROUND

Technical Field

Embodiments of the present invention generally relates to an image forming apparatus such as a copier, a facsimile machine, a printer, or a multifunction peripheral (MFP) having at least two of copying, printing, facsimile transmission, plotting, and scanning capabilities, and a toner conveyance device used therein.

Description of the Related Art

Generally, electrophotographic image forming apparatuses such as copiers and minters include a cleaning device to collect untransferred toner. Specifically, image forming apparatuses form an electrostatic latent image on a photoconductor drum (i.e., an image bearer), develop the latent image into a toner image with a developing device, and transfer the toner image at a transfer position onto a recording medium, such as a sheet of paper. The cleaning device removes, from the photoconductor drum, residual toner (untransferred toner) that is not transferred at the transfer position onto the recording medium.

For example, in the cleaning device, the collected toner is transported by a conveying screw, falls (slides) down a downward passage, and reaches a horizontal conveyance passage communicating with the lower end of the downward passage. In the conveyance passage, a conveying screw disposed therein horizontally transports the collected toner, and the collected toner is either transported to the developing device for reuse or collected in the waste-toner container as waste toner.

There are image forming apparatuses in which a reciprocating member is disposed in the downward passage, through which the collected toner falls (slides down), and the reciprocating member moves up and down along an inclined wall face of the downward passage to prevent a bridge formed with the collected toner inside the downward passage.

SUMMARY

An embodiment of the present invention provides a toner conveyance device that includes a downward passage through which toner falls, a reciprocating member disposed in the downward passage, to move up and down along the downward passage in a vertical direction in which the downward passage extends, a conveyance passage communicating with a lower end of the downward passage and extending in a direction crossing the vertical direction, and a conveyor disposed in the conveyance passage. The conveyor rotates around an axis extending along the conveyance passage and transports the toner falling from the downward passage to the conveyance passage in an axial direction of the conveyor. The toner conveyance device further includes a flexible member projecting from a bottom of the reciprocating member toward the conveyance passage. The flexible member extends in the axial direction of the conveyor and moves, together with the reciprocating member, in the vertical direction. When the reciprocating member is at a lowest position in a movable range, a lower end of the flexible member opposes a downstream portion of the conveyor downstream from an upper end of the conveyor in a rotation direction of the conveyor.

In another embodiment, an image forming apparatus includes an image bearer on which an image is formed with toner, and the toner conveyance device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
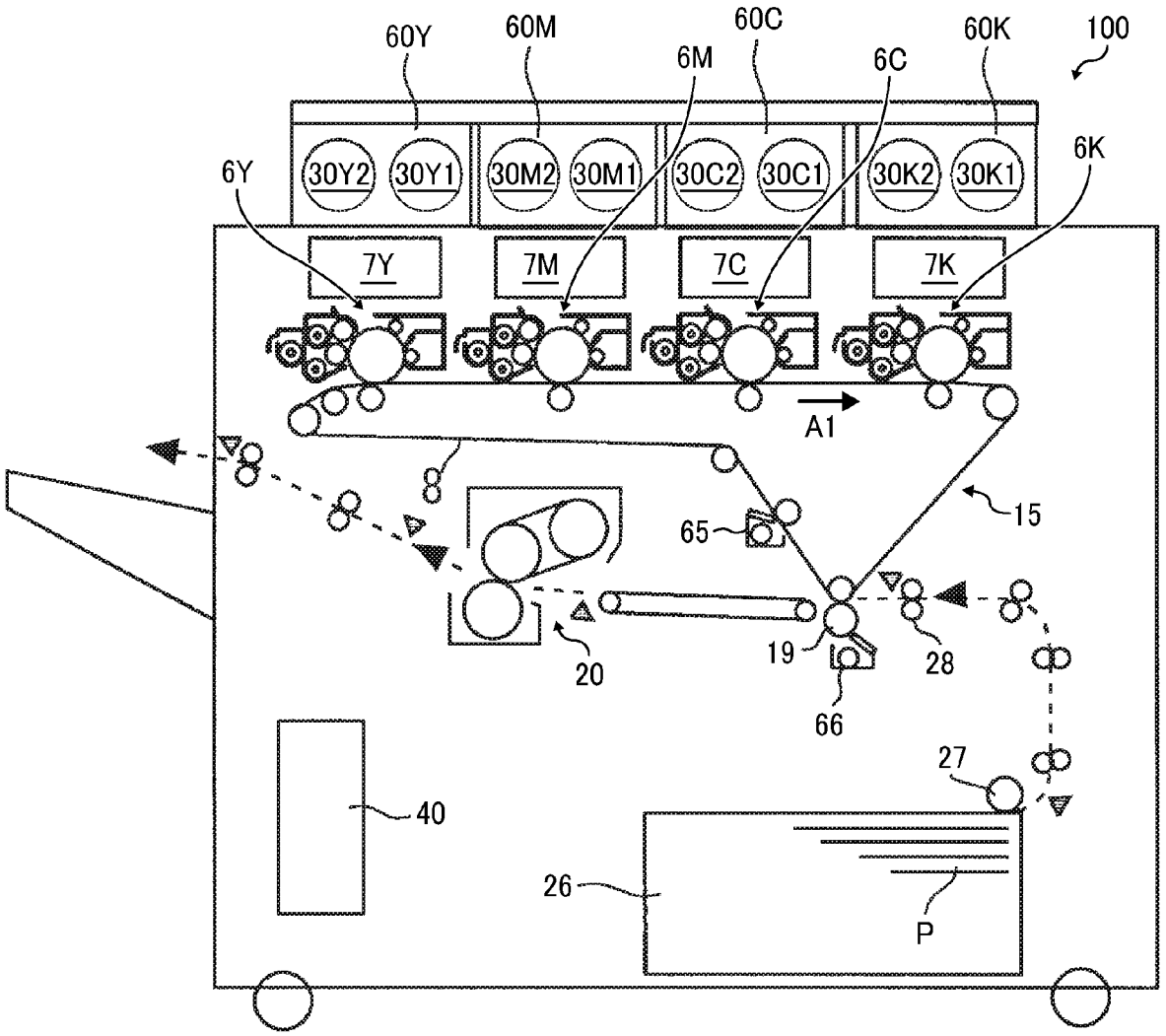
FIG. 1 is a schematic diagram illustrating a configuration of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings; specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan; and black images, respectively, and hereinafter may be omitted when color discrimination is not necessary.

Figure 2:
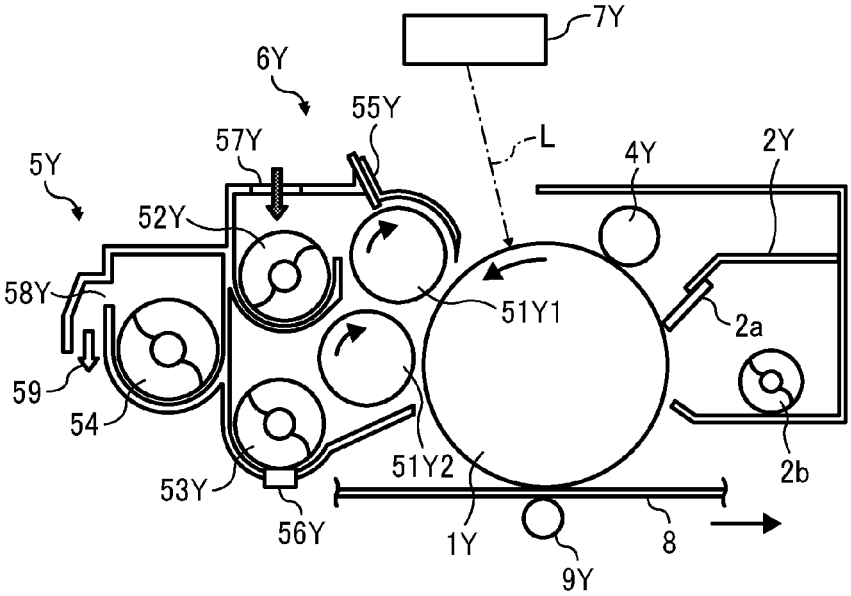
FIG. 2 is a schematic cross-sectional view of an image forming unit included in the image forming apparatus illustrated in FIG. 1.

Referring to FIGS. 1 and 2, a configuration and operation of an image forming apparatus 100 according to the present embodiment is described below.

FIG. 1 is a schematic view of the image forming apparatus 100, which in the present embodiment is a printer. FIG. 2 is an image forming unit 6 of the image forming apparatus 100 illustrated in FIG. 1.

As illustrated in FIG. 1, developer supply devices 60 (60Y, 60M, 60C, and 60K) are disposed above a body of the image forming apparatus 100. In the developer supply devices 60Y, 60M, 60C, and 60K, two developer containers 30Y1 and 30Y2 for yellow, two developer containers 30M1 and 30M2 for magenta, two developer containers 30C1 and 30C2 for cyan, and two developer containers 30K1 and 30K2 for black (collectively "developer containers 30") are removably mounted. The developer containers 30 are cylindrical or substantially cylindrical (including polygonal shapes). Below the developer supply devices 60Y, 60M, 60C, and 60K (powder supply devices), image forming units 6Y, 6M, 6C, and 6K, respectively corresponding to yellow, magenta, cyan, and black, are disposed, and exposure devices 7Y, 7M, 7C, and 7K are interposed therebetween. The image forming units 6Y, 6M, 6C, and 6K are disposed side by side facing an intermediate transfer device 15 including an intermediate transfer belt 8. Below the intermediate transfer device 15, a sheet conveyance path through which a recording sheet P is transported is defined. In a lower part of the body, the image forming apparatus 100 includes a sheet feeder 26 to contain the recording sheet P and a waste-toner container 40 in which the waste toner is collected.

Referring to FIG. 2, the image forming unit 6Y for yellow includes a photoconductor drum 1Y serving as an image bearer and further includes a charging device 4Y, a developing device 5Y, a cleaning device 2Y, a discharger, and the like disposed around the photoconductor drum 1Y. Image forming process, namely, charging, exposure, development, transfer, and cleaning processes are performed on the photoconductor drum 1Y, and thus a yellow toner image is formed on the photoconductor drum 1Y.

The other image forming units 6M, 6C, and 6K have a similar configuration to that of the yellow image forming unit 6Y except the color of the toner used therein and form magenta, cyan, and black toner images, respectively. Thus, only the image forming unit 6Y is described below and descriptions of other image forming units 6M, 6C, and 6K are omitted.

Referring to FIG. 2, the photoconductor drum 1Y is rotated counterclockwise in FIG. 2 by a driving motor. At a position where the photoconductor drum 1Y opposes the charging device 4Y, the charging device 4Y charges the surface of the photoconductor drum 1Y uniformly (a charging process).

When the photoconductor drum 1Y reaches a position to receive a laser beam emitted from the exposure device 7Y (i.e., a writing device), the photoconductor drum 1Y is scanned with the laser beam L, and thus an electrostatic latent image for yellow is formed thereon (an exposure process).

Then, the photoconductor drum 1Y reaches a position facing the developing device 5Y, where the latent image is developed with toner into a yellow toner image (development process).

When the surface of the photoconductor drum 1Y carrying the toner image reaches a position facing a primary transfer roller 9Y via an intermediate transfer belt 8, the toner image is transferred therefrom onto the intermediate transfer belt 8 (a primary transfer process). After the primary transfer process, a certain amount of toner tends to remain untransferred on the photoconductor drum 1Y.

When the surface of the photoconductor drum 1Y reaches a position facing the cleaning device 2Y, a cleaning blade 2*a* collects the untransferred toner from the photoconductor drum 1Y into the cleaning device 2Y (a cleaning process). In the cleaning device 2Y, a conveying screw 2*b* transports the untransferred toner (i.e., waste toner) substantially horizontally, after which a toner conveyance device 70 (described later) transports the waste toner toward the waste-toner container 40. The waste toner is stored in the waste-toner container 40.

Subsequently, the discharger removes residual potentials from the surface of the photoconductor drum 1Y.

Thus, a sequence of image forming processes performed on the photoconductor drum 1Y is completed.

The above-described image forming processes are performed in the image forming units 6M, 6C, and 6K similarly to the yellow image forming unit 6Y. That is, the exposure devices 7M, 7C, and 7K disposed above the image forming units 6M, 6C, and 6K in FIG. 1 direct the laser beams L according to image data onto the photoconductor drums 1 in the image forming units 6M, 6C, and 6K.

Then, the toner images formed on the respective photoconductor drums 1 through the development process are primarily transferred therefrom and superimposed one on another on the intermediate transfer belt 8. Thus, a multicolor toner image is formed on the intermediate transfer belt 8.

In FIG. 1, the intermediate transfer device 15 includes the intermediate transfer belt 8, the four primary transfer rollers 9, a driving roller, a secondary transfer backup roller, multiple tension rollers, a cleaning backup roller, an intermediate-transfer cleaning device 65, a secondary transfer roller 19, and a secondary-transfer cleaning device 66. The intermediate transfer belt 8 is supported by and entrained around multiple rollers to rotate in the direction, indicated by arrow A1 illustrated in FIG. 1 (clockwise) as one (the driving roller) of the multiple rollers rotates.

Specifically, the four primary transfer rollers 9 are pressed against the corresponding photoconductor drums 1 via the intermediate transfer belt 8, and four contact portions between the primary transfer rollers 9 and the corresponding photoconductor drums 1 are hereinafter referred to as primary transfer nips. A transfer voltage (a primary transfer bias) opposite in polarity to the toner is applied to each primary transfer roller 9.

The intermediate transfer belt 8 rotates in the direction indicated by arrow A1 in FIG. 1 and sequentially passes through the primary transfer nips. Then, the single-color toner images are transferred from the photoconductor drums 1 primarily and superimposed one on another on the intermediate transfer belt 8.

Then, the intermediate transfer belt 8 carrying the multicolor toner image reaches a position facing the secondary transfer roller 19. The secondary transfer backup roller and the secondary transfer roller 19 press against each other via the intermediate transfer belt 8, and the contact portion therebetween is hereinafter referred to as a secondary transfer nip. The multicolor toner image on the intermediate transfer belt 8 is secondarily transferred onto the recording sheet P transported to the secondary transfer nip (a secondary transfer process) A certain amount of toner tends to remain untransferred on the intermediate transfer belt 8 after the secondary transfer process.

Although the secondary transfer roller 19 is used to form the secondary transfer nip with the intermediate transfer belt 8 in the present embodiment, alternatively, a transfer belt can be used instead.

Subsequently, when the surface of the intermediate transfer belt 8 reaches a position facing the intermediate-transfer cleaning device 65, the intermediate-transfer cleaning device 65 removes the untransferred toner from the intermediate transfer belt 8.

Thus, a sequence of image forming processes performed on the intermediate transfer belt 8 is completed.

In the intermediate-transfer cleaning device 65, a conveying screw transports the untransferred toner (i.e., waste toner) substantially horizontally, after which the toner conveyance device 70 (described later) transports the waste toner toward the waste-toner container 40. The waste toner is stored in the waste-toner container 40.

The image forming apparatus 100 according to the present embodiment further includes the secondary-transfer cleaning device 66 to remove and collect toner and paper dust adhering to the surface of the secondary transfer roller 19. In the secondary-transfer cleaning device 66, a conveying screw transports the substances, such as the collected toner, substantially horizontally, after which the toner conveyance device 70 (described later) transports the collected substances toward the waste-toner container 40. The collected substances are stored in the waste-toner container 40.

In particular, in the present embodiment, since adjustment of image forming conditions (i.e., a process control mode) or cleaning of the secondary transfer roller 19 (a cleaning mode) is performed in a non-image formation period (an idle time) before or after a normal image forming process, the amount of toner collected in the intermediate-transfer cleaning device 65 or the secondary-transfer cleaning device 66 is relative large. In the process control, a toner image (i.e., a patch pattern) is formed on the intermediate transfer belt 8 without feeding the recording sheet P thereto.

Referring back to FIG. 1, the recording sheet P is fed from the sheet feeder 26 disposed in the lower part of the image forming apparatus 100 to the secondary transfer nip via a sheet feeding roller 27, a registration roller pair 28, and the like.

Specifically, the sheet feeder 26 contains multiple recording sheets P piled one on another. The sheet feeding roller 27 rotates counterclockwise in FIG. 1 to feed the recording sheet P on the top in the sheet feeder 26 toward a nip of the registration roller pair 28.

The registration roller pair 28 (a timing roller pair) stops rotating temporarily, stopping the recording sheet P with a leading edge of the recording sheet P nipped in the registration roller pair 28. The registration roller pair 28 resumes rotating to transport the recording sheet P to the secondary transfer nip, timed to coincide with the arrival of the multicolor toner image formed on the intermediate transfer belt 8. Thus, the multicolor image is transferred onto the recording sheet P.

The recording sheet P carrying the multicolor toner image is transported to a fixing device 20. In the fixing device 20, a fixing belt and a pressing roller apply heat and pressure to the recording sheet P to fix the multicolor toner image on the recording sheet P.

Subsequently, the recording sheet P is discharged by a pair of discharge rollers outside the image forming apparatus 100. The recording sheets P are sequentially stacked as output images on a stack tray.

Thus, a sequence of image forming processes performed in the image forming apparatus 100 is completed.

Next, a configuration and operation of the developing device 5Y is described in further detail below with reference to FIG. 2.

The developing device 5Y employs premix developing. The developer supply device 60Y supplies fresh developer (two-component developer including toner and carrier) the developer container 30Y1 or 30Y2 through a supply inlet 57Y into the developing device 5Y as required. Further, degraded developer (i.e., carrier mainly) is discharged outside the developing device 5Y, from an outlet 58Y and through a developer discharge passage 59. The developer discharged from the developer discharge passage 59 is transported, substantially horizontally, by a conveying screw, transported by the toner conveyance device 70 (described later) toward the waste-toner container 40, and stored therein.

The developing device 5Y includes a magnetic sensor 56Y to detect the percentage of toner in developer (toner concentration), based on which the developer is supplied to the developing device 5Y. Specifically, when the toner concentration detected by the magnetic sensor 56Y is below a predetermined value or range (e.g., $7\mp3\%$ by weight), the developer supply device 60Y is driven to supply the developer from the developer container 30Y1 or 30Y2 to the developing device 5Y.

Next, a configuration and operation of the developing device 5Y is described in further detail below.

With reference to FIG. 2, the developing device 5Y includes two developer bearers, namely, first and second developing rollers 51Y1 and 51Y2; three developer conveyors, namely, conveying screws 52Y, 53Y, and 54Y; and a doctor blade 55Y serving as a developer regulator. The casing and the interior of the developing device 5Y together define three conveyance compartments (i.e., a supply compartment, a collection compartment, and a stirring compartment) serving as a circulation passage.

The two developing rollers (the first and second developing rollers 51Y1 and 51Y2) are disposed facing the photoconductor drum 1Y and arranged in the direction of rotation of the photoconductor drum 1Y (in the direction of arc). Each of the first and second developing rollers 51Y1 and 51Y2 includes a cylindrical sleeve made of a nonmagnetic material and is rotated clockwise in FIG. 2 by a developing driving motor. The nonmagnetic material includes, but not limited to, aluminum, brass, stainless steel, and conductive resin. Magnets secured inside the sleeves of the first and second developing rollers 51Y1 and 51Y2 generate magnetic fields to cause the developer to stand on end on the surfaces of the sleeves. Along magnetic force lines arising from the magnets in a normal direction, the carrier in the developer stands on end, in a chain shape. The toner adheres to the carrier standing on end in the chain shape, thus forming a magnetic brush. As the sleeve rotates, the magnetic brush is transported in the direction of rotation of the sleeve (clockwise in the drawing).

The doctor blade 55Y serving as the developer regulator faces the first developing roller 51Y1 on the upstream side in the direction of rotation of the photoconductor drum 1Y to adjust the amount of developer on the first developing roller 51Y1.

Each of the conveying screws 52Y, 53Y, and 54Y includes a shaft and a spiral blade disposed on the shaft and stirs developer contained in the developing device 5Y while circulating the developer in the longitudinal direction thereof (hereinafter "developer conveyance direction"), which is perpendicular to the surface of the paper on which FIG. 2 is drawn and identical to the axial direction of the first and second developing rollers 51Y1 and 51Y2.

The developing device 5Y is designed to discharge excessive developer therefrom to the outside. Specifically, the outlet 58Y, which is to discharge a portion of developer contained in the developing device 5Y, is formed in the wall defining the conveyance compartment containing the third conveying screw 54Y. More specifically, as the developer supply device 60Y supplies the developer to the developing device 5Y, the level (i.e., an upper face) of developer therein rises. When the level of developer exceeds a threshold, excessive developer is discharged through the outlet 58Y to the outside. Thus, degraded carrier contaminated with resin base or additives of toner is automatically discharged from the developing device 5Y. Accordingly, degradation of image quality is inhibited over time.

Next, referring to FIGS. 3 through 10, the configuration and operation of the toner conveyance device 70 (and the image forming apparatus 100) according to the present embodiment are described in further detail below.

Figure 4:
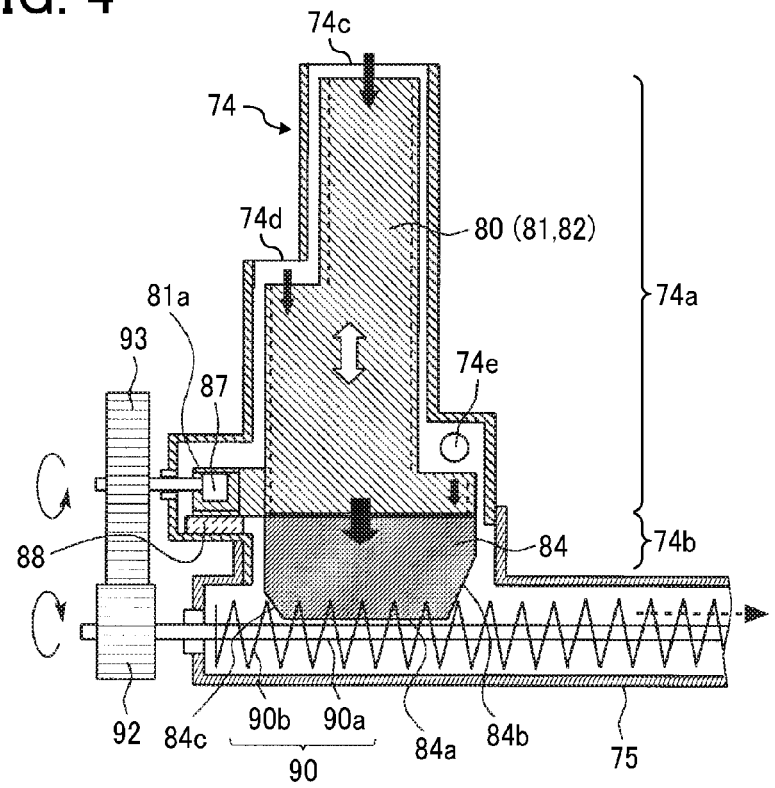
FIG. 4 is a cross-sectional view of a downward passage and a horizontal conveyance passage of the toner conveyance route illustrated in FIG. 3.
Figure 5:
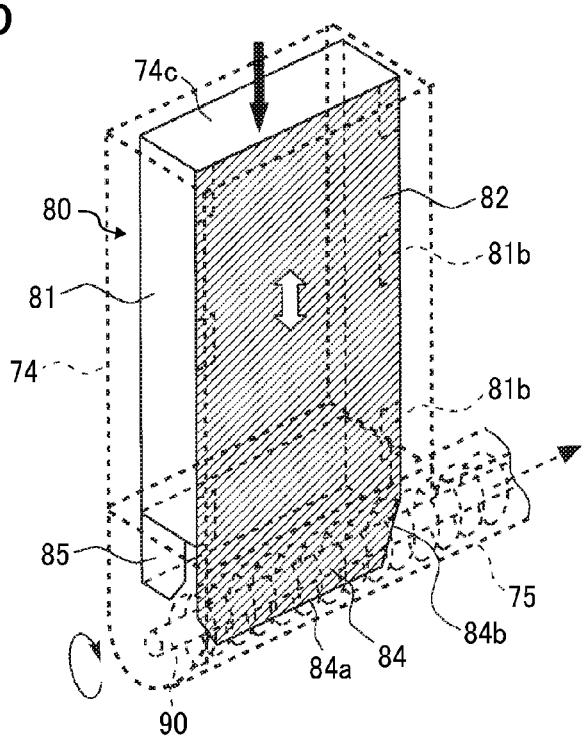
FIG. 5 is a schematic perspective view of a reciprocating member and flexible portions attached thereto, according to an embodiment.
Figure 7:
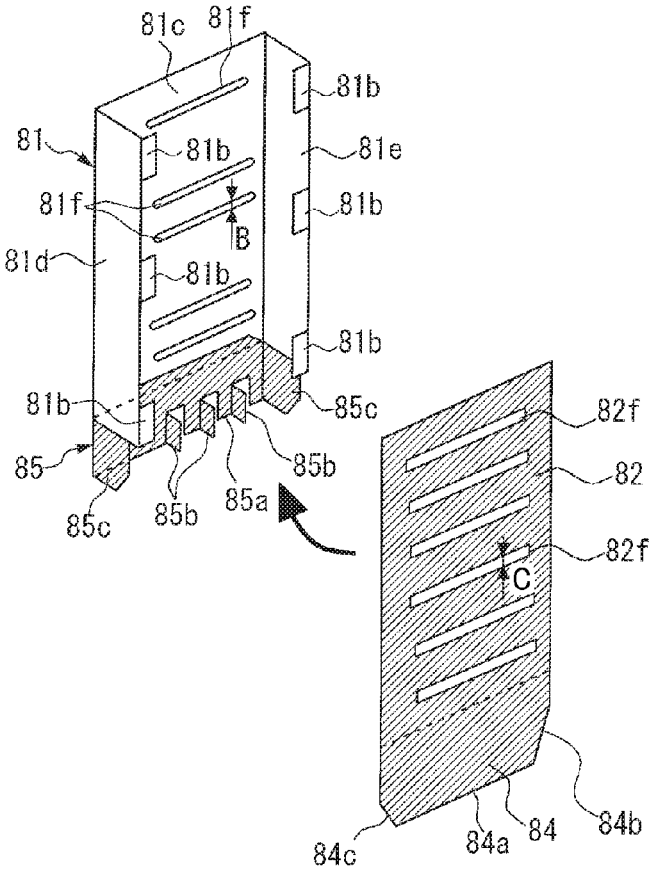
FIG. 7 is a schematic exploded view in which the reciprocating member is decomposed into a rigid body and a sheet.
Figure 10:
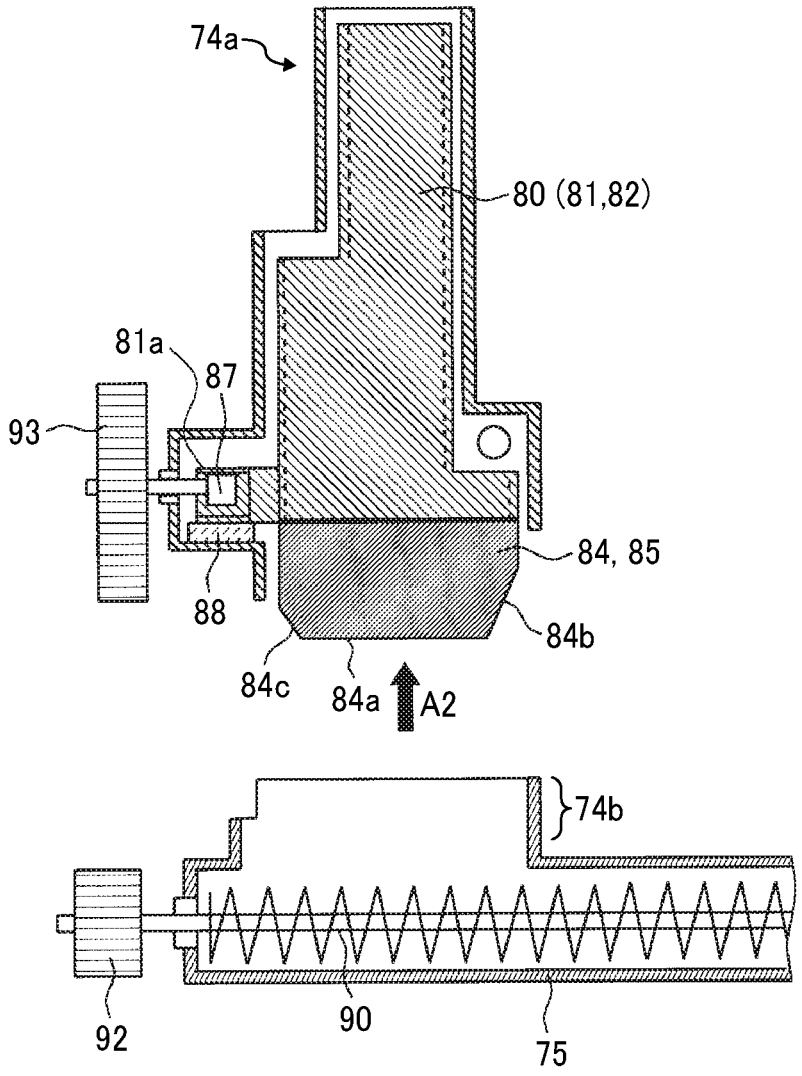
FIG. 10 is a schematic exploded view in which the downward passage is decomposed into a first passage portion and a second passage portion.

To facilitate the comparison between FIGS. 4 and 10 and FIGS. 5 and 7, a second flexible portion 85 (i.e., a lateral-U-shaped flexible portion) is omitted in FIGS. 4 and 10, and projecting portions including second and third inlets 74*d* and 74*e* are omitted in FIGS. 5 and 7.

Figure 3:
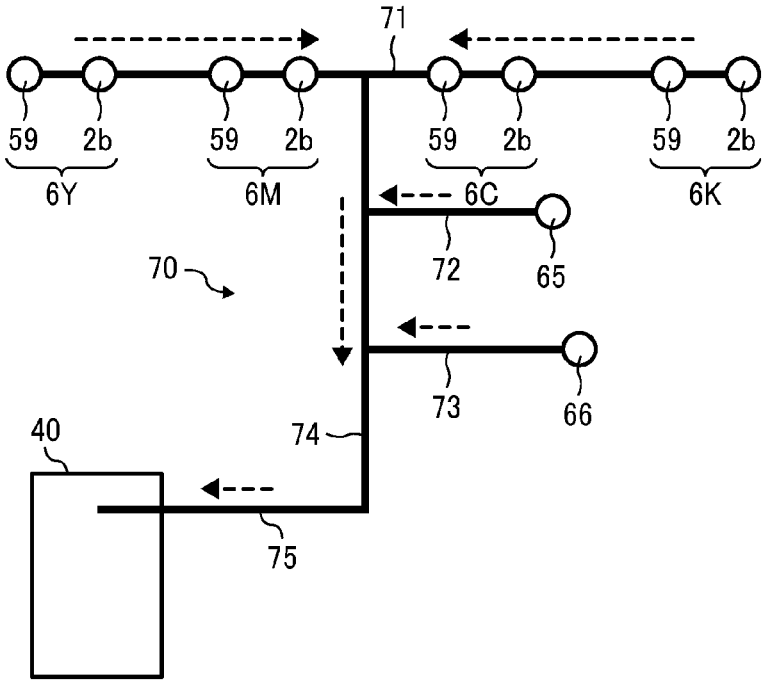
FIG. 3 is a schematic diagram of a toner conveyance route (for collecting toner) according to an embodiment.

Referring to FIG. 3, the toner conveyance device 70 according to the present embodiment transports, to the waste-toner container 40, the untransferred toner (waste toner) discharged by the conveying screw 2*b* of the cleaning device 2 of each of the four image forming units 6Y, 6M, 6C, and 6K; the developer (waste developer) discharged, via the developer discharge passage 59, from the developing device 5 of each of the four image forming units 6Y, 6M, 6C, and 6K; the untransferred toner (waste toner) transported from the intermediate-transfer cleaning device 65; and toner and other unwanted materials (waste) transported from the secondary-transfer cleaning device 66.

Being filled to capacity with the waste toner and other waste, the waste-toner container 40 is removed from the image forming apparatus 100 and replaced with an empty waste-toner container 40.

In the present embodiment, as illustrated in FIG. 3, the toner conveyance device 70 includes five conveyance passages, namely, a first horizontal conveyance passage 71, a second horizontal conveyance passage 72, a third horizontal conveyance passage 73, a downward passage 74, and a fourth horizontal conveyance passage 75. In each of the horizontal conveyance passages 71, 72, 73, and 75, a conveying coil is disposed to transport the toner and the like horizontally along the conveyance passage. The structure and operation of the conveying coil are similar to those of a conveying coil 90 disposed in the fourth horizontal conveyance passage 75.

The waste toner transported by the conveying screw 2*b* of each of the four image forming units 6Y, 6M, 6C, and 6K and the waste developer discharged from the developer discharge passage 59 of each of the four image forming units 6Y, 6M, 6C, and 6K are transported through the first horizontal conveyance passage 71 to a first inlet 74*c* (illustrated in FIG. 4) at an upper end of the downward passage 74. Then, the toner and the developer flow from the first inlet 74*c* into the downward passage 74, fall under the gravity, flow through the fourth horizontal conveyance passage 75 to the waste-toner container 40, and are collected in the waste-toner container 40.

The waste toner transported from the intermediate-transfer cleaning device 65 is transported through the second horizontal conveyance passage 72 to the second inlet 74*d* (illustrated in FIG. 4) located in a middle portion of the downward passage 74. Then, the toner flows from the second inlet 74*d* into the downward passage 74, falls under the gravity, flows through the fourth horizontal conveyance passage 75 to the waste-toner container 40, and is collected in the waste-toner container 40.

The unwanted materials, such as waste toner, transported from the secondary-transfer cleaning device 66 is transported through the third horizontal conveyance passage 73 to the third inlet 74*e* (illustrated in FIG. 4) located in a middle position of the downward passage 74. Then, the toner flows from the third inlet 74*e* into the downward passage 74, falls under the gravity, flows through the fourth horizontal conveyance passage 75 to the waste-toner container 40, and is collected in the waste-toner container 40.

Referring to FIGS. 4 through 6B, the toner conveyance device 70 according to the present embodiment includes the downward passage 74 through which the toner falls and the fourth horizontal conveyance passage 75 communicating with the lower end thereof.

In the present embodiment, the downward passage 74 is a hollow component shaped like a quadrangular prism and made of a resin material. As described above, the downward passage 74 includes the first inlet 74*c* in the ceiling thereof, the second inlet 74*d* located in a middle portion projecting laterally (to the left in FIG. 4), and the third inlet 74*e* located in another middle portion projecting laterally (to the right in FIG. 4). Inside the downward passage 74, the waste (including the toner, developer, paper dust, and mixture thereof) flowing from the inlets 74*c* through 74*e* falls down as indicated by black arrows in FIG. 4.

Although the downward passage 74 extends almost vertically in the present embodiment, the downward passage 74 can be inclined relative to the vertical direction.

The fourth horizontal conveyance passage 75 communicates with the lower end of the downward passage 74 and extends in a direction (almost horizontal in the present embodiment but can be inclined from the horizontal direction) crossing the vertical direction. In the present embodiment, the downward passage 74 has an almost rectangular cross section (perpendicular to the direction in which toner falls), and the long side of the rectangular cross section matches the direction in which the fourth horizontal conveyance passage 75 extends.

Inside the fourth horizontal conveyance passage 75, the conveying coil 90 is disposed. The conveying coil 90 (i.e., a conveyor) includes a coiled portion 90*b* winding in spiral around a shaft 90*a*, with a gap secured in the radial direction from the shaft 90*a*. The conveying coil 90 is configured to rotate around an axis extending in the longitudinal direction (almost horizontal) of the fourth horizontal conveyance passage 75, thereby transporting the toner falling from the downward passage 74 to the fourth horizontal conveyance passage 75 as indicated by broken arrow illustrated in FIG. 4.

The fourth horizontal conveyance passage 75 is almost cylindrical corresponding to the outer diameter of the coiled portion 90*b* to reduce the gap between the inner face of the fourth horizontal conveyance passage 75 and the coiled portion 90*b* of the conveying coil 90. This structure enhances the capability of the conveying coil 90 to transport the toner in the fourth horizontal conveyance passage 75.

Although the conveyor in the fourth horizontal conveyance passage 75 is the conveying coil 90, alternatively, a conveying screw or the like can be used instead.

Referring to FIGS. 4 through 6B, in the present embodiment, a reciprocating member 80 is disposed inside the downward passage 74. The reciprocating member 80 is shaped like a hollow quadrangular prism extending along the four side-wall inner faces of the quadrangular prismatic downward passage 74. The reciprocating member 80 reciprocates in the vertical direction (indicated by an outlined arrow in FIGS. 4 through 6B) in which the downward passage 74 extends, along the inner faces of the downward passage 74.

Referring to FIGS. 5 and 7, in the present embodiment, the reciprocating member 80 includes a rigid body 81 made of a metal plate such as a zinc plate having a thickness of from about 0.8 to 1.5 mm and a sheet 82 (i.e., a flexible sheet) made of a flexible material such as polyethylene terephthalate (PET) having a thickness of about 0.25 mm.

The rigid body 81 is shaped into a lateral U-shape having angular corners to follow the three of the four side-wall inner faces of the downward passage 74. That is, as illustrated in FIG. 7, the rigid body 81 includes three opposing faces (first, second, and third opposing faces 81*c*, 81*d*, and 81*e*) to face the three side-wall inner faces of the downward passage 74, respectively.

By contrast, the sheet 82 is attached to the rigid body 81 to extend along the remaining one of the four side-wall inner faces of the downward passage 74. Specifically, referring to FIG. 7, the sheet 82 is attached, via double-sided adhesive tape or glue, to bonding portions 81*b* (parallel to the first opposing face 81*c*). The bonding portions 81*b* are bent from the second opposing face 81*d* and the third opposing face 81*e* of the rigid body 81, respectively.

A bottom portion of the sheet 82 is a first flexible portion 84 (i.e., a flexible member) that is cantilevered by the rigid body 81, and the second flexible portion 85 is attached to a lower portion of the rigid body 81 to face the first flexible portion 84, which are described in further detail later.

Thus, in the present embodiment, the reciprocating member 80 is shaped to face all of the four side-wall inner faces of the downward passage 74 and moves reciprocally along all of the four side-wall inner faces. This structure better inhibits formation of toner bridges on all of the four side-wall inner faces of the downward passage 74 compared with a case where a reciprocating member faces and moves along a part of the inner faces of the downward passage 74. That is, the reciprocating member 80 reciprocates in the direction in which the toner falls, along the four side-wall inner faces of the downward passage 74. Accordingly, adhering of toner to and solidification of toner on any of the four side-wall inner faces are inhibited, thereby inhibiting formation of toner bridges. Even when a toner bridge is formed (toner adheres to and solidifies on the inner face), the reciprocating member 80 breaks the toner bridge. Therefore, the toner conveying capability (or toner flowability) in the toner conveyance device 70 (the downward passage 74) is not degraded by toner bridges.

In particular, compared with fresh toner, the waste toner falling through the downward passage 74 is lower in flowability and easily adheres to the inner face of the downward passage 74. Accordingly, this structure is advantageous.

Additionally, since the reciprocating member 80 is not constituted by a rigid body only but includes the rigid body 81 and the sheet 82, the reciprocating member 80 is not very heavy, and smooth reciprocation is available.

Since the reciprocating member 80 is not constituted by a flexible sheet only but includes the rigid body 81 and the sheet 82, a certain degree of rigidity is secured to prevent deformation of the reciprocating member 80.

Referring to FIG. 4, the rigid body 81 of the reciprocating member 80 includes a projecting portion 81*a* projecting to a position outside a space enclosed by the inner faces of the downward passage 74 into which the toner can fall. The projecting portion 81*a* is a bent of the rigid body 81 and produced by bending of a sheet metal. The projecting portion 81*a* includes a face parallel to the first opposing face 81*c* and a ceiling and a bottom connected with the parallel face.

Figure 9A:
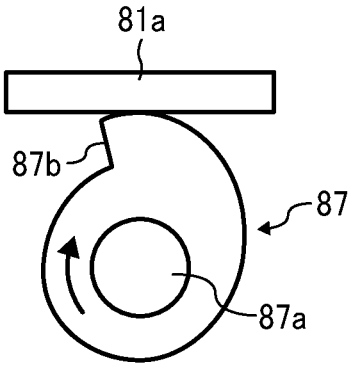
FIG. 9A is a schematic view of an eccentric cam in contact with a projecting portion of the reciprocating member.
Figure 9B:
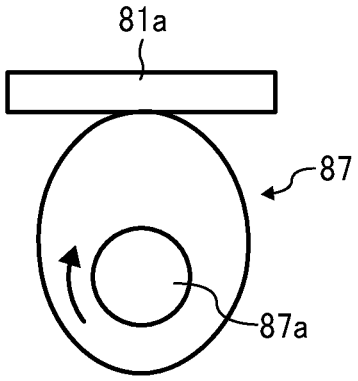
FIG. 9B is a schematic view of a comparative eccentric cam in contact with the projection of the reciprocating member.

Referring to FIGS. 4 and 9A, an eccentric cam 87 is in contact with or abuts against, from below, the projecting portion 81*a* of the rigid body 81 (the above-described ceiling). As the eccentric cam 87 rotates in a predetermined direction in this state, the projecting portion 81*a* moves up and down along the cam shape. Thus, the reciprocating member 80 is caused to reciprocate in the vertical direction.

A gear 93, which is disposed on a rotation shaft 87*a* of the eccentric cam 87, mashes with a gear 92 disposed on the shaft 90*a* of the conveying coil 90. As the eccentric cam 87 rotates in conjunction with rotation of the conveying coil 90 driven by a driving motor, the reciprocating member 80 reciprocates.

Disposing the eccentric cam 87 abutting against the rigid body 81 (the projecting portion 81*a* in particular) to move the reciprocating member 80 back and forth is advantageous in securing transmission of drive force to the reciprocating member 80 to move the reciprocating member 80 back and forth, compared with a configuration in which the eccentric cam 87 is disposed abutting against the sheet member (the flexible member) to move the reciprocating member 80.

Additionally, the toner does not directly fall to the portion (the projecting portion 81*a*) of the rigid body 81 that contacts the eccentric cam 87. Accordingly, smooth reciprocation of the reciprocating member 80 is not inhibited by adhesion of toner to the eccentric cam 87 or the projecting portion 81*a*.

Referring to FIGS. 4 through 6B, the first flexible portion 84 (a flexible member) is disposed on the lower portion of the reciprocating member 80 to project toward the fourth horizontal conveyance passage 75 located below the reciprocating member 80.

Figure 6A:
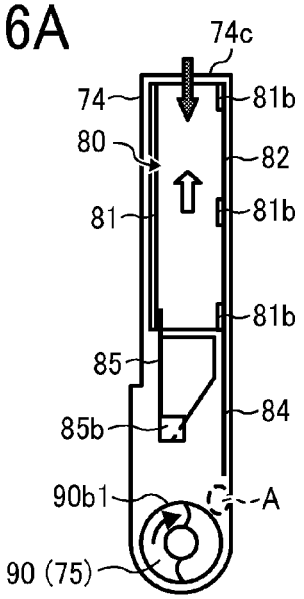
FIG. 6A is a schematic view of the reciprocating member and the flexible portions located at a highest position.
Figure 6B:
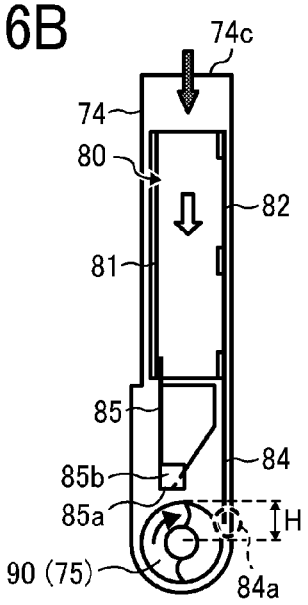
FIG. 6B is a schematic view of the reciprocating member and flexible portions located at a lowest position.

The first flexible portion 84 extends in the lateral direction in FIG. 4 and perpendicular to the surface of the paper on which FIGS. 6A and 6B are drawn, and the first flexible portion 84 has a certain width in the direction in which the fourth horizontal conveyance passage 75 extends (i.e., the axial direction of the conveying coil 90). In the present embodiment, the range of the first flexible portion 84 in the axial direction of the conveying coil 90 is substantially same as the length of the communicating portion between the downward passage 74 and the fourth horizontal conveyance passage 75.

The first flexible portion 84 is united with the sheet 82 of the reciprocating member 80 into a single piece. That is, the first flexible portion 84 is an end portion of the sheet 82 cantilevered by the rigid body 81. In other words, the first flexible portion 84 (the flexible member) is made of PET and has a thickness of about 0.25 mm similar to the sheet 82. When the first flexible portion 84 and the sheet 82 are formed as a single piece, the number of components can be smaller.

With this structure, the first flexible portion 84 can move up and down together with the reciprocating member 80. As illustrated in FIG. 6B, when the reciprocating member 80 is at a lowest position in a movable range thereof (i.e., a lower end 84*a* of the first flexible portion 84 is at a lowest position in a movable range thereof), the lower end 84*a* is located in an area A indicated by broken circle in FIG. 6A. The area A in on or adjacent to the inner face of the fourth horizontal conveyance passage 75 facing a portion of the conveying coil 90 downstream from an upper end 90*b*1 thereof in the direction in which the conveying coil 90 rotates.

In the area A enclosed with the broken circle in FIG. 6A, the toner conveyed by the conveying coil 90, which rotates in the direction indicated by the arrow, tends to accumulate, and, in the fourth horizontal conveyance passage 75 communicating with the lower end of the downward passage 74, the possibility of toner bridges is high in the area A.

In the present embodiment, as the reciprocating member 80, together with the first flexible portion 84, repeatedly moves between the highest position illustrated in FIG. 6A and the lowest position illustrated in FIG. 6B, the lower end 84*a* of the first flexible portion 84 dubs the toner (likely to form a bridge) accumulating in the area A and loosen the toner. Accordingly, the toner is inhibited from forming a bridge on the inner face of the fourth horizontal conveyance passage 75 and degrading the toner conveying capability (or toner flowability) in the toner conveyance device 70.

In particular, the first flexible portion 84 is made of a flexible material and cantilevered so that the lower end 84*a* becomes a free end. Accordingly, even when the first flexible portion 84 contacts the conveying coil 90 or the inner face, the first flexible portion 84 can flexibly deform, thereby alleviating damage of the first flexible portion 84 and that of the component contacted by the first flexible portion 84.

In the present embodiment, as illustrated in FIG. 6B, the first flexible portion 84 is configured such that, when the reciprocating member 80 is at the lowest position, the lower end 84*a* of the first flexible portion 84 is located on or adjacent to the inner face of the fourth horizontal conveyance passage 75 in a range H illustrated in FIG. 6B. That is, when the reciprocating member 80 is at the lowest position in the movable range thereof, the lower end 84*a* is below the upper end 90*b*1 of the conveying coil 90 and above the center of rotation of the conveying coil 90.

If the lower end 84*a* of the first flexible portion 84 moves below the range H in FIG. 6B, there is a risk that the first flexible portion 84 is entangled in the conveying coil 90.

The relative position described with reference to FIG. 6B can inhibit the entanglement of the first flexible portion 84 in the conveying coil 90 and alleviate the toner bridge in the fourth horizontal conveyance passage 75.

Referring to FIGS. 5 through 7, in the present embodiment, the second flexible portion 85 is disposed to project from the bottom of the rigid body 81 of the reciprocating member 80 toward the fourth horizontal conveyance passage 75.

The second flexible portion 85 is made of a flexible material such as PET and has a thickness of about 0.25 mm. Further, similar to the rigid body 81, the second flexible portion 85 is shaped into an angular and lateral U-shape extending along the three side-wall inner faces of the downward passage 74. The second flexible portion 85 is attached (or glued) to the bottom of the rigid body 81 (the first opposing face 81*c*). The second flexible portion 85 and the first flexible portion 84 opposing the second flexible portion 85 together forms a cross section similar to the cross section of the downward passage 74 (substantially rectangular and perpendicular to the toner falling direction) below the downward passage 74.

This structure can prevent the toner falling from the downward passage 74 from scattering outside the above-described cross section and smoothly guide the toner to the communicating portion with the fourth horizontal conveyance passage 75. Additionally, the second flexible portion 85 is made of a flexible material and cantilevered so that a lower end 85*a* thereof becomes a free end. Accordingly, even when the second flexible portion 85 contacts the conveying coil 90 or the inner face, the second flexible portion 85 can flexibly deform, thereby alleviating damage of the second flexible portion 85 and that of the component contacted thereby. In particular, in the present embodiment, sides 85*c* (see FIG. 7) at lateral ends of the second flexible portion 85 are not glued or attached to the rigid body 81.

In the present embodiment, when the second flexible portion 85, which is movable vertically together with the reciprocating member 80, is located at the lowest position in the movable range thereof as illustrated in FIG. 6B, the lower end 85*a* is at (or adjacent to) a position opposing the upper end 90*b*1 of the conveying coil 90 from above. That is, the vertical length of the second flexible portion 85 is set so that the lower end 85*a* is positioned higher than the lower end 84*a* of the first flexible portion 84.

This structure can prevent the second flexible portion 85 from being entangled in the conveying coil 90.

Additionally, in the present embodiment, as illustrated in FIGS. 6A through 7, the lower portion of the second flexible portion 85 includes a plurality of bent portions 85*b* (i.e., raised portions) projecting in the direction crossing the rotation axis direction and the vertical direction. In FIG. 7, the bent portions 85*b* are substantially perpendicular to the first opposing face 81*c*. The bent portions 85*b* are produced by forming cut portions in the lower end 85*a* and the second flexible portion 85 and bending the cut portions at almost right angles.

Referring to FIGS. 6A and 6B, as the reciprocating member 80 moves up and down, the bent portions 85*b* loosen the toner accumulating around the upper end 90*b*1 of the conveying coil 90. The toner is likely to accumulate in the portion around the upper end 90*b*1 of the conveying coil 90 though the degree is lower compared with the above-described area A. Accordingly, the bent portions 85*b* are advantageous.

Referring to FIG. 7, a plurality of through holes 81*f* and 82*f* (slits) is formed in the faces of the reciprocating member 80 opposing the inner face of the downward passage 74.

Specifically, the through holes 81*f* are rectangular and formed in the first opposing face 81*c* of the rigid body 81. The through holes 81*f* extending in the lateral direction in FIG. 7 are lined in the vertical direction. The through holes 82*f* formed in the sheet 82 are also substantially rectangular, extend in the lateral direction, and lined in the vertical direction.

Even when the toner enters the gap between the reciprocating member 80 and the inner face of the downward passage 74, the plurality of through holes 81*f* and 82*f* help the toner to return to the inside of the reciprocating member 80. Thus, the through holes 81*f* and 82*f* alleviate adhesion of toner to the reciprocating member 80 and the inner faces of the downward passage 74.

Preferably, such through holes are formed also in the second opposing face 81*d* and the third opposing face 81*e* of the rigid body 81.

Figure 8A:
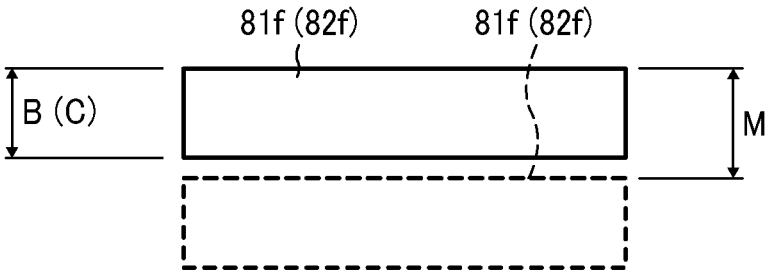
FIGS. 8A and 8B are views of movement of a through hole in the reciprocating member.
Figure 8B:
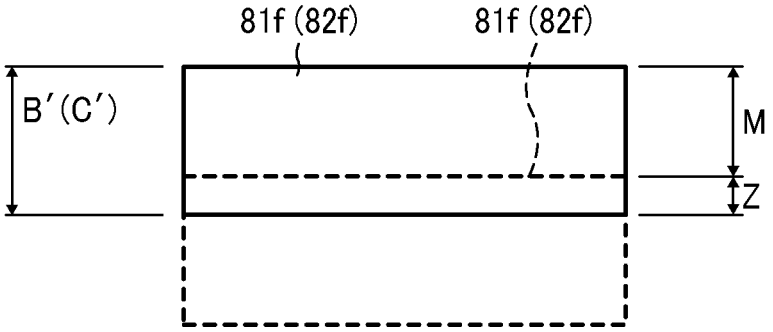

In FIGS. 8A and 8B, the solid lines represent the through hole 81*f* (or 82*f*) when the reciprocating member 80 is at the highest position in the reciprocation span M, and broken lines represent the through hole 81*f* (or 82*f*) when the reciprocating member 80 is at the lowest position in the reciprocation span M. As illustrated in FIG. 8A, in the present embodiment, a length B of the through holes 81*f* and a length C of the through holes 82*f* in the vertical direction are shorter than a reciprocation span M in which the reciprocating member 80 moves up and down.

This structure can inhibit the inconvenience illustrated in FIG. 8, in which a range Z in which the reciprocating member 80 does not oppose (or contact) the inner face of the downward passage 74 is created.

Specifically, in FIG. 8, a length B' of the through holes 81*f* and a length C' of the through holes 82*f* are longer than the span M, and the range Z in which the reciprocating member 80 does not oppose (or contact) the inner face of the downward passage 74 is created due to the through holes 81*f* and 82*f* In the range Z, the possibility of toner bridge is higher.

In the present embodiment, since the lengths B and C of the through holes 81*f* and 82*f* are smaller than the reciprocation span M, formation of the through holes 81*f* and 82*f* do not increase the occurrence of toner bridge.

Referring to FIG. 9A, the periphery of the eccentric cam 87 includes a stepped portion 87*b*. This structure can increase the speed at which the reciprocating member 80 moves down (the speed of downward movement of the reciprocating member 80 when the eccentric cam 87 rotates in the direction indicated by an arrow from the position illustrated in FIG. 9A), compared with the structure illustrated in FIG. 9B, in which the eccentric cam 87 does not include a step.

Thus, the toner adhering to the reciprocating member 80 (or the inner face of the downward passage 74) is easily shaken off, thereby better preventing toner bridge.

It is to be noted that, in the present embodiment, as illustrated in FIG. 4, the downward passage 74 is provided with a pad 88 (an impact absorbing pad) to contact the projecting portion 81*a* of the rigid body 81 when the reciprocating member 80 moves to the lowest position. Specifically, the pad 88 to absorb impact is made of polyurethane foam or the like and attached to a portion outside the space into which the toner can fall, enclosed by the four side-wall inner faces of the downward passage 74. When the reciprocating member 80 moves to the lowest position, the bottom of the projecting portion 81*a* contacts the pad 88.

The pad 88 can soften the impact or the sound of impact when the reciprocating member 80 hits the downward passage 74 or the eccentric cam 87 as the reciprocating member 80 falls.

Additionally, since the portion (the projecting portion 81*a*) of the rigid body 81 that contacts the pad 88 is in the range to which the toner does not directly fall, decrease of the capability of the pad 88 caused by adhesion of toner to the pad 88 or the projecting portion 81*a* is inhibited.

Referring to FIGS. 4 and 10, the downward passage 74 includes a first passage portion 74*a* in which the reciprocating member 80 is disposed and a second passage portion 74*b* in which the first and second flexible portions 84 and 85 are disposed.

As illustrated in FIG. 10, the first passage portion 74*a* is configured to hold the reciprocating member 80 together with the first and second flexible portions 84 and 85. By contrast, the second passage portion 74*b* is united with the fourth horizontal conveyance passage 75 into a single piece.

As illustrated in FIG. 10, the first passage portion 74*a*, together with the reciprocating member 80 and the first and second flexible portions 84 and 85, is removably attached to the second passage portion 74*b*. In other words, the first passage portion 74*a*, together with the reciprocating member 80 and the first and second flexible portions 84 and 85, is removable in the direction indicated by arrow A2 from the second passage portion 74*b* (and the fourth horizontal conveyance passage 75).

Thus, the downward passage 74 is decomposable at a position close to the fourth horizontal conveyance passage 75 to facilitate the maintenance of the downward passage 74 and the fourth horizontal conveyance passage 75. Further, the attachment and removal are not difficult since the first and second flexible portions 84 and 85 can deform upon interference with the second passage portion 74*b* in attachment and removal of the first passage portion 74*a* to and from the second passage portion 74*b* (and the fourth horizontal conveyance passage 75). Further, the structure according to the present embodiment obviate the necessity of installing the reciprocating member 80 and the first and second flexible portions 84 and 85 in each of the first and second passage portions 74*a* and 74*b* of the downward passage 74, the number of components does not increase.

Additionally, in the present embodiment, as illustrated in FIGS. 4 and 10, the lower end 84*a* of the first flexible portion 84 includes tapered portions 84*b* and 84*c* at both ends in the lateral direction in FIGS. 4 and 10. In other words, the lower corners of the substantially rectangular first flexible portion 84 are tapered.

With the tapered portions 84*b* and 84*c*, the first flexible portion 84, which projects relatively long from the first passage portion 74*a*, is less likely to interfere with the second passage portion 74*b* in attachment and removal of the first passage portion 74*a* to and from the second passage portion 74*b* (and the fourth horizontal conveyance passage 75). Thus, the attachment and removal can be easy.

It is to be noted that, as illustrated in FIG. 10, the tapered portion 84*b* on one side (on the right in FIG. 10) is larger than the tapered portion 84*c* on the other side (on the left in FIG. 10) since the height of the second passage portion 74*b* is higher on right in FIG. 10 than on the left in FIG. 10. This structure can efficiently inhibit the interference between the first flexible portion 84 and the second passage portion 74*b*.

Even in a structure in which the height of the second passage portion 74*b* is not different in the lateral direction in FIG. 10, making the tapered portion 84*b* on one side larger than the tapered portion 84*c* on the other side is advantageous in helping the first flexible portion 84 to deform to fit in the second passage portion 74*b* in attaching the first passage portion 74*a*, together with the reciprocating member 80 and the first and second flexible portions 84 and 85, to the second passage portion 74*b*, thereby making the attachment and removal work easier.

As described above, the toner conveyance device 70 according to the present embodiment includes the reciprocating member 80 that reciprocates along the side-wall inner faces of the downward passage 74 and the first flexible portion 84 projecting from the bottom of the reciprocating member 80 toward the fourth horizontal conveyance passage 75. When the lower end 84*a* of the first flexible portion 84 reaches the lowest position as the reciprocating member 80 moves down, the lower end 84*a* is located on or adjacent to the inner face of the fourth horizontal conveyance passage 75 facing the portion of the conveying coil 90 downstream from the upper end 90*b*1 of the conveying coil 90 in the direction in which the conveying coil 90 rotates.

This structure can inhibit the toner bridge on the inner face of the fourth horizontal conveyance passage 75 communicating with the lower end of the downward passage 74 to which the toner falls.

Although the description above concerns the multicolor image forming apparatus 100 that includes the multiple image forming units 6Y, 6M, 6C, and 6K, one or more aspects of this specification can adapt to a single-color or monochrome image forming apparatus including a single image forming unit.

Additionally, although the above-described image forming apparatus 100 includes the developing device 5 that is premix type and contains two-component developer including toner and carrier in the above-described embodiment, one or more aspects of this specification can adapt to image forming apparatuses including a developing device containing one-component developer or a developing device that is not premix type and contains two-component developer (replacement of developer is not performed).

In such configurations, effects similar to those described above are also attained.

Additionally, in the above-described embodiment, although the toner conveyance device 70 transports the untransferred toner as waste toner to the waste-toner container 40, one or more aspects of this specification can adapt to a toner conveyance passage (or a reused toner conveyance device) to transport the untransferred toner to the developing device for recycle or reuse.

In such configurations, effects similar to those described above are also attained.

It is to be noted that, the term "reciprocates along the inner faces of the downward passage" includes reciprocating in a direction deviated from the inner face although the direction generally confirms to the inner face, in addition to reciprocating in a direction strictly conforming to the inner face.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A toner conveyance device comprising:

a downward passage through which toner falls;

a reciprocating member that includes a rigid body and a flexible sheet that forms a hollow passage along a vertical length of the downward passage, the reciprocating member being disposed in the downward passage, to move up and down along the downward passage in a vertical direction in which the downward passage extends;

a conveyance passage communicating with a lower end of the downward passage and extending in a direction crossing the vertical direction;

a rotatable conveyor disposed in the conveyance passage to convey the toner in an axial direction of the conveyor; and a flexible member disposed at a bottom of the reciprocating member, the flexible member extending in the axial direction of the conveyor, the flexible member to move in the vertical direction together with the reciprocating member, wherein, when the reciprocating member is at a lowest position in a movable range of the reciprocating member, a lower end of the flexible member opposes a downstream portion of the conveyor downstream from an upper end of the conveyor in a rotation direction of the conveyor.

2. The toner conveyance device according to claim 1, wherein, when the reciprocating member is at the lowest position in the movable range, the lower end of the flexible member is lower than the upper end of the conveyor and higher than a center of rotation of the conveyor.

3. The toner conveyance device according to claim 1, wherein the downward passage is quadrangular and prismatic, wherein the reciprocating member is shaped into a hollow quadrangular prism extending along four side-wall inner faces of the downward passage and wherein the rigid body extends along three of the four side-wall inner faces of the downward passage; and the flexible sheet is attached to the rigid body to extend along a remaining one of the four side-wall inner faces of the downward passage, wherein the flexible member and the flexible sheet of the reciprocating member are formed as a single piece, and wherein the reciprocating member includes a flexible portion disposed at a bottom of the rigid body and extending along the three of the four side-wall inner faces of the downward passage.

4. The toner conveyance device according to claim 3, wherein the flexible portion is to move in the vertical direction together with the reciprocating member, wherein, when the reciprocating member is at the lowest position in the movable range, a lower end of the flexible portion opposes the upper end of the conveyor, and wherein a lower portion of the flexible portion includes a plurality of bent portions projecting in a direction crossing the axial direction of the conveyor and the vertical direction.

5. The toner conveyance device according to claim 4, further comprising:

an eccentric cam having a stepped portion; and an impact absorbing pad to absorb impact generated by the rigid body moving down, wherein the rigid body of the reciprocating member includes a projecting portion projecting toward a position outside a space enclosed by the four side-wall inner faces of the downward passage, wherein the eccentric cam is to rotate to cause the reciprocating member to reciprocate in a state in which the eccentric cam is in contact with the projecting portion of the rigid body, and wherein the impact absorbing pad is disposed to contact the projecting portion of the rigid body when the reciprocating member moves to the lowest position in the movable range.

6. The toner conveyance device according to claim 1, wherein the reciprocating member includes a plurality of through holes in a face opposing one of four side-wall inner faces of the downward passage, and wherein each of the plurality of through holes has a vertical length shorter than a reciprocation span of the reciprocating member.

7. The toner conveyance device according to claim 1, wherein the downward passage includes:

a first passage portion in which the reciprocating member is disposed, the first passage portion to hold the reciprocating member together with the flexible member; and a second passage portion in which the flexible member is disposed, the second passage portion continuous with the conveyance passage, wherein the first passage portion, together with the reciprocating member and the flexible member, is removable from the second passage portion.

8. The toner conveyance device according to claim 1, wherein lower corners at both ends of the flexible member in the axial direction of the conveyor are tapered.

9. The toner conveyance device according to claim 1, wherein, when the reciprocating member is at the lowest position in the movable range of the reciprocating member, the lower end of the flexible member is adjacent to one of four side-wall inner faces of the downward passage.

10. An image forming apparatus comprising:

an image bearer on which an image is formed with toner; and the toner conveyance device according to claim 1.

11. A toner conveyance device comprising:

a downward passage through which toner falls;

a reciprocating member disposed in the downward passage, to move up and down along the downward passage in a vertical direction in which the downward passage extends;

a conveyance passage communicating with a lower end of the downward passage and extending in a direction crossing the vertical direction;

a rotatable conveyor disposed in the conveyance passage to convey the toner in an axial direction of the conveyor; and a flexible member disposed at a bottom of the reciprocating member, the flexible member extending in the axial direction of the conveyor, the flexible member to move in the vertical direction together with the reciprocating member, wherein the reciprocating member includes a plurality of bent portions projecting in a direction crossing the axial direction of the conveyor and the vertical direction.

12. The toner conveyance device according to claim 11, wherein the plurality of bent portions is a plurality of cutouts having one side uncut and continuous with a lower portion of the reciprocating member.

13. The toner conveyance device according to claim 11, wherein, when the reciprocating member is at a lowest position in a movable range of the reciprocating member, a lower end of the flexible member opposes a downstream portion of the conveyor downstream from an upper end of the conveyor in a rotation direction of the conveyor.

14. The toner conveyance device according to claim 11, wherein the downward passage is quadrangular prismatic, wherein the reciprocating member is shaped into a hollow quadrangular prism extending along four side-wall inner faces of the downward passage and includes:

a rigid body extending along three of the four side-wall inner faces of the downward passage; and a flexible sheet attached to the rigid body to extend along a remaining one of the four side-wall inner faces of the downward passage, wherein the flexible member and the flexible sheet of the reciprocating member are formed as a single piece, and wherein the reciprocating member includes a flexible portion disposed at a bottom of the rigid body and extending along the three of the four side-wall inner faces of the downward passage.

15. The toner conveyance device according to claim 14, wherein the plurality of bent portions is disposed in the flexible portion of the reciprocating member.

16. A toner conveyance device comprising:

a downward passage through which toner falls;

a reciprocating member disposed in the downward passage, to move up and down along the downward passage in a vertical direction in which the downward passage extends;

a conveyance passage communicating with a lower end of the downward passage and extending in a direction crossing the vertical direction;

a rotatable conveyor disposed in the conveyance passage to convey the toner in an axial direction of the conveyor; and a flexible member disposed at a bottom of the reciprocating member, the flexible member extending in the axial direction of the conveyor, the flexible member to move in the vertical direction together with the reciprocating member, wherein the reciprocating member includes a plurality of through holes in a face opposing one of four side-wall inner faces of the downward passage, and wherein each of the plurality of through holes has a vertical length shorter than a reciprocation span of the reciprocating member.

17. The toner conveyance device according to claim 16, further comprising:

an eccentric cam having a stepped portion; and an impact absorbing pad to absorb impact, wherein the reciprocating member includes a rigid body having a projecting portion projecting toward, a position outside a space enclosed by the four side-wall inner faces of the downward passage, wherein the eccentric cam is to rotate to cause the reciprocating member to reciprocate in a state in which the eccentric cam is in contact with the projecting portion of the rigid body, and wherein the impact absorbing pad is disposed to contact the projecting portion of the rigid body when the reciprocating member moves to a lowest position in a movable range of the reciprocating member.

18. The toner conveyance device according to claim 16, wherein, when the reciprocating member is at a lowest position in a movable range of the reciprocating member, a lower end of the flexible member opposes a downstream portion of the conveyor downstream from an upper end of the conveyor in a rotation direction of the conveyor.

19. The toner conveyance device according to claim 1, wherein the reciprocating member includes a projecting portion above the flexible member that projects into a recess in a wall forming the downward passage.

20. The toner conveyance device according to claim 1, wherein the downward passage has a plurality of inlets at various heights along the vertical length of the downward passage.

* * * * *